US009428201B1

(12) United States Patent
Samora

(10) Patent No.: US 9,428,201 B1
(45) Date of Patent: Aug. 30, 2016

(54) LOCOMOTIVE BLUE LIGHT REVERSER KEY

(71) Applicant: Jurislabs, LLC, Mountain View, CA (US)

(72) Inventor: Cecil A. Samora, Clovis, NM (US)

(73) Assignee: Jurislabs, LLC, Mountain View, CA (US)

( * ) Notice: Subject to any disclaimer, the term of this patent is extended or adjusted under 35 U.S.C. 154(b) by 0 days.

(21) Appl. No.: 14/879,092

(22) Filed: Oct. 8, 2015

Related U.S. Application Data

(63) Continuation of application No. 14/294,863, filed on Jun. 3, 2014, now Pat. No. 9,156,481, which is a continuation of application No. 13/841,458, filed on Mar. 15, 2013, now Pat. No. 8,740,156.

(51) Int. Cl.
*B61L 15/00* (2006.01)

(52) U.S. Cl.
CPC ..... *B61L 15/009* (2013.01)

(58) Field of Classification Search
CPC ..... B61L 21/00; B61C 1/00
USPC ..... 74/519, 523, 543, 545, 548; 477/27, 96, 477/113
See application file for complete search history.

(56) References Cited

U.S. PATENT DOCUMENTS

| | | | | |
|---|---|---|---|---|
| 2,784,265 | A * | 3/1957 | Weide | 200/5 R |
| 3,131,575 | A * | 5/1964 | Shimanckas | 477/113 |
| 3,842,653 | A * | 10/1974 | Blonn, Sr. | 477/96 |
| 5,134,895 | A * | 8/1992 | Harmon et al. | 74/483 R |
| 5,492,511 | A * | 2/1996 | Kozminski | 477/27 |
| 5,533,695 | A * | 7/1996 | Heggestad et al. | 246/62 |
| 5,542,891 | A * | 8/1996 | Kettle et al. | 477/96 |
| 5,907,976 | A * | 6/1999 | Santoro et al. | 74/491 |
| 7,435,180 | B2 * | 10/2008 | Kruegel et al. | 464/52 |
| 8,504,226 | B2 * | 8/2013 | Brooks et al. | 701/19 |
| 2011/0313596 | A1 * | 12/2011 | Ecton et al. | 701/2 |
| 2012/0038474 | A1 * | 2/2012 | De Sanzo | 340/468 |

* cited by examiner

*Primary Examiner* — Jason C Smith
(74) *Attorney, Agent, or Firm* — Imperium Patent Works; T. Lester Wallace; Amir V. Adibi

(57) ABSTRACT

A locomotive blue light reverser key has a handle portion and a shaft portion that is connected to the handle portion. The handle portion includes a Light Emitting Diode (LED), a switch, a battery that powers the LED, and a blue tinted lens. The shaft portion is insertable into a reverser of a locomotive. During a blue signal procedure when the train is not permitted to move, a train operator uses the blue light reverser key to indicate the blue signal procedure is in effect. The train operator activates the LED on the handle portion and inserts the blue light reverser key into the reverser. The shaft portion does not engage any locking mechanism within the reverser, and the reverser key prevents the locomotive from moving forward or backward. The blue light emitted from the blue light reverser key also notifies other train operators of the blue signal procedure.

19 Claims, 6 Drawing Sheets

USING THE REVERSER KEY TO INDICATE A BLUE SIGNAL PROCEDURE (SECOND EMBODIMENT)

FUNCTIONAL REVERSER KEY WITH ELECTRONIC COMPONENTS WITHIN THE HANDLE (THIRD EMBODIMENT)

LOCOMOTIVE BLUE LIGHT REVERSER KEY

CROSS REFERENCE TO RELATED APPLICATIONS

This application is a continuation of, and claims the benefit under 35 U.S.C. §120 from, nonprovisional U.S. patent application Ser. No. 14/294,863, entitled "Locomotive Blue Light Reverser Key," filed on Jun. 3, 2014, now U.S. Pat. No. 9,156,481. U.S. patent application Ser. No. 14/294,863 is a continuation of, and claims the benefit under 35 U.S.C. §120 from, nonprovisional U.S. patent application Ser. No. 13/841,458, entitled "Locomotive Blue Light Reverser Key," filed on Mar. 15, 2013, now U.S. Pat. No. 8,740,156. This application incorporates by reference U.S. patent application Ser. No. 14/294,863. This application also incorporates by reference U.S. patent application Ser. No. 13/841,458.

TECHNICAL FIELD

The described embodiments relate generally to railroad safety, and more particularly to devices for notifying locomotive operators of blue signal procedures.

BACKGROUND INFORMATION

Locomotives are operated by railroad controllers to operate on railways that extend throughout the continent. At times it is desirable to conduct certain procedures on the railroad that may require a locomotive to remain standing and not be moved until it is safe to do so. These procedures typically involve railroad employees conducting inspection of the railway, conducting safety tests, performing repairs, or working on locomotives. Federal Law mandates that blue signal protection be provided to railroad employees whenever they are conducting such work. This is also known as a blue signal procedure. During a blue signal procedure, a blue signal must be displayed at each end of a locomotive, among other locations. Although the blue signals may notify railroad employees and locomotive operators, there is a risk that the blue signals will not be visible to a locomotive operator. A safer mechanism for notifying locomotive operators of blue signal procedures is desired.

SUMMARY

A locomotive blue light reverser key comprises a handle portion and a shaft portion that is connected to the handle portion. The shaft portion is attached to the handle portion and extends from the handle portion. The handle portion includes a Light Emitting Diode (LED), a switch mechanism, and a battery. A blue tinted lens is attached at an end of the handle portion. A locomotive operator uses the blue light reverser key when a blue signal procedure is in effect on the railroad. During a blue signal procedure, locomotives are not permitted to move and must remain stationary. The blue signal procedure is mandated under Federal law whenever railroad employees are conducting inspection of the railway, performing safety tests, carrying out repairs, or working on locomotives. Any movement of the train may result in serious injury to a railroad employee.

In normal operating conditions (no blue signal), a locomotive operator inserts a reverser handle into a reverser. The reverser is part of a control stand in a cabin of the locomotive. In addition to the reverser, the control stand also includes a dynamic brake and a power throttle. The dynamic brake is used to decelerate the locomotive, and the power throttle is used to control diesel engines or other power providing units of the locomotive. The reverser handle controls the forward and reverse rotation of the motors to selectively drive the locomotive forward or backwards. The reverser is set to one of three positions: neutral, forward and backward. The reverser handle is also removable from the reverser. Because the reverser handle is removable and controls the movement of the locomotive, the reverser handle is also referred to as a "train key".

In a blue signal procedure, the locomotive operator activates the LED on the handle portion and inserts the blue light reverser key into the reverser. The shaft portion does not engage any locking mechanism within the reverser. The shaft portion does not include any V-notch or indentations that will trip a locking mechanism in the reverser. In this fashion, the blue light reverser key prevents the reverser from rotating to the forward position or to the reverse position when the blue light reverser key is inserted into the reverser. As a result, a train operator will not be able to accidentally move the train after the blue light reverser key is inserted into the reverser. In addition, the blue light emitted from the blue light reverser key also notifies other train other operators that may enter the cabin unaware of the blue signal protection. Moreover, because the blue light reverser key occupies the reverser, a train key capable of controlling the reverser may not be inadvertently inserted.

In another embodiment, a blue light reverser key includes a handle portion having an LED, a switch mechanism, a battery, control circuitry, a Radio Frequency (RF) receiver, and an antenna. An RF signal received onto the antenna is detected by the RF receiver and in turn, causes control circuitry to control switch mechanism to activate the LED. All locomotive operators equipped with a blue light reverser key having the RF receiver will be notified of the blue signal. For example, a railroad employee upon deciding to initiate a blue signal condition generates an RF signal transmitted from a master controller using an antenna. The RF signal is detected by each of the reverser keys carried by the locomotive operators, and each of the locomotive operators receives notification of the blue signal condition when the LEDs are activated.

In yet another embodiment, a reverser key includes a handle portion and a shaft portion having a V-notch that unlocks a tripping mechanism within the reverser of the locomotive. The reverser key is a fully functional train key and is usable by a locomotive operator to control the reverser and drive the train forwards and backwards. The handle portion contains at least one electronic device, and contains a Light Emitting Diode (LED), a switch mechanism, and a battery. The reverser key has a dual use in that it functions as a train key to control the reverser and also functions as a flashlight providing convenience to the locomotive operator.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
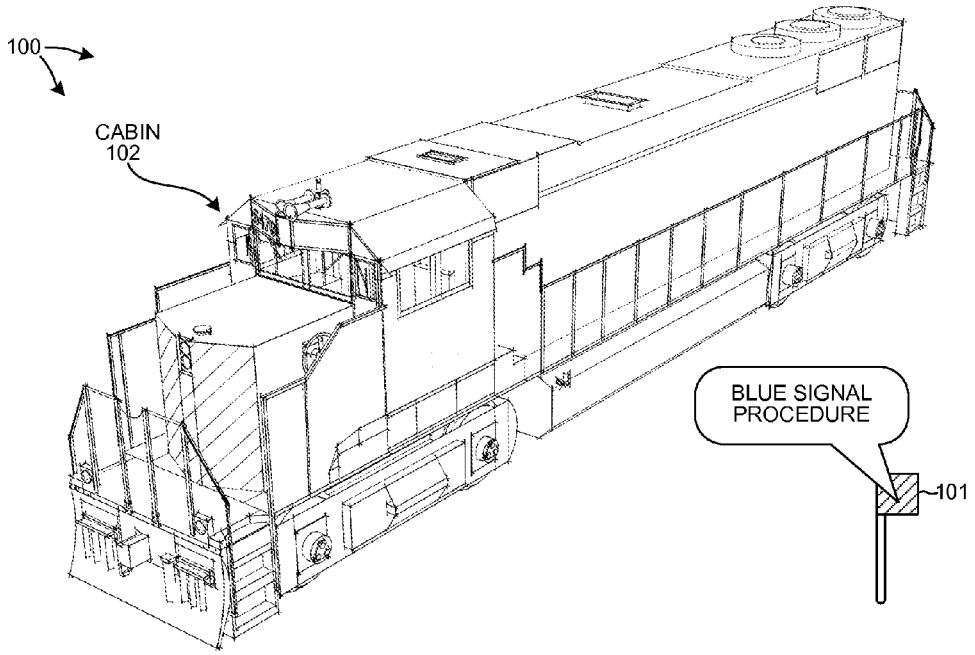
FIG. 1 is a diagram of a locomotive 100 operating on a railroad during a blue signal procedure.

FIG. 1 is a diagram of a locomotive 100 operating on a railroad during a blue signal procedure. During a blue signal procedure, the locomotive 100 is not permitted to move either forwards or backwards and must remain stationary. The blue signal procedure is mandated under Federal law whenever railroad employees are conducting inspection of the railway, performing safety tests, carrying out repairs, or working on locomotives. A blue signal must be displayed at each end of rolling equipment. The blue signal must be a clearly distinguishable blue flag or blue light by day, and a blue light by night. Reference numeral 101 identifies a blue flag. A locomotive operator in locomotive cabin 102 may see blue flag 101 and understand that a blue flag procedure is in place and the locomotive must remain stationery.

Figure 2:
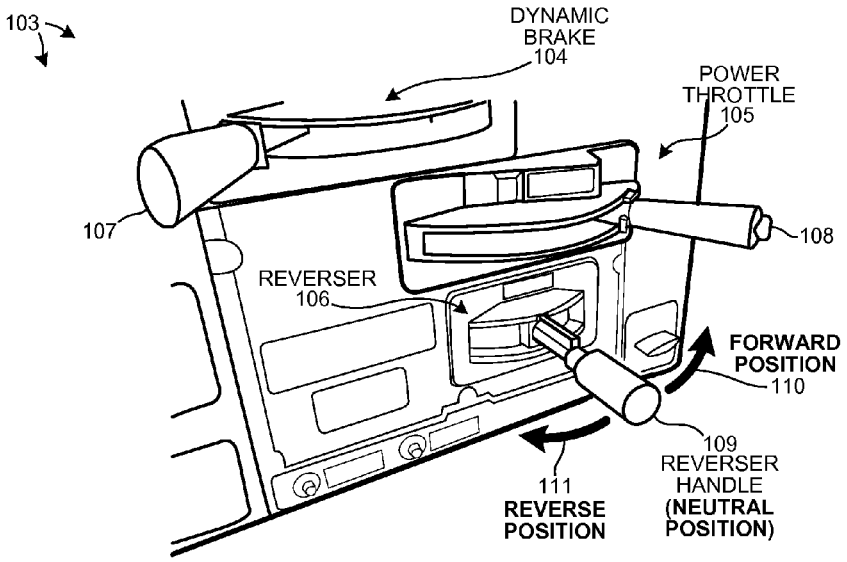
FIG. 2 is a diagram of a control stand 103 of locomotive 100.

FIG. 2 is a diagram of a control stand 103 of locomotive 100. The control stand 103 includes a dynamic brake 104, a power throttle 105, and a reverser 106. Dynamic brake control handle 107 is used to control the dynamic brake 104 to decelerate locomotive 100. Throttle control handle 108 is used to control the power throttle 105 to drive diesel engines or other power providing units of locomotive 100. Reverser handle 109 controls the forward and reverse rotation of the motors to selectively drive the locomotive 100 forward or backwards. The reverser handle 109 is set to one of three positions: neutral position, forward position and backwards position. In FIG. 2, the reverser handle 109 is in a neutral position. Rotating reverser handle 109 in the direction of bold arrow 110 would result in the reverser handle 109 being set to the forward position, whereas rotating reverser handle 109 in the direction of bold arrow 111 would result in the reverser handle 109 being set to the reverse position.

Reverser handle 109 is removable from the reverser 106. A reverser socket on the reverser 106 allows the locomotive operator to insert and remove the reverser handle 109 from the reverser 106. Because the reverser handle 109 is removable and permits the locomotive operator to control the train, the reverser handle 109 is also referred to as a "train key". In the example of FIG. 2, the reverser handle 109 must remain in the neutral position until the blue signal procedure has ended. If, however, the train operator removes the train key and departs from the cabin to allow a new train operator to enter the cabin, then there is a risk that the new train operator will not be aware of the blue signal procedure. As a result, there is a risk that the new operator will insert the train key, move the train forwards or backwards, and cause injury to a railroad employee.

Figure 3:
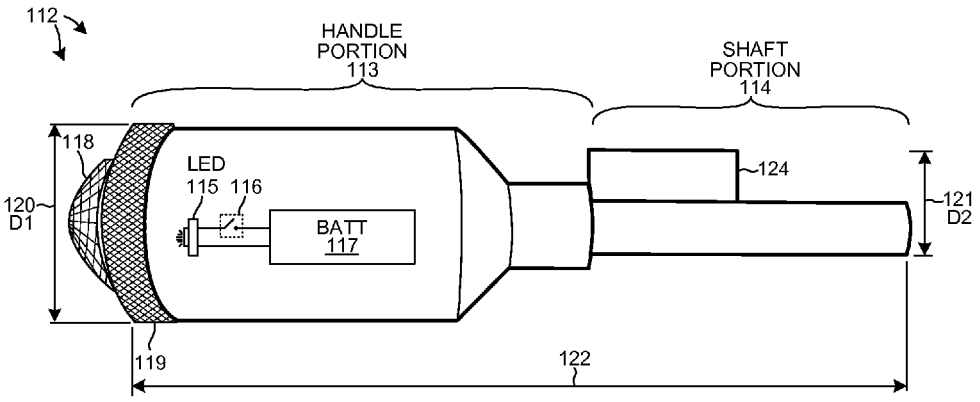
FIG. 3 is a diagram of a novel locomotive reverser key 112 that emits a blue light.

FIG. 3 is a diagram of a novel locomotive reverser key 112 that emits a blue light. The reverser key 112 includes a handle portion 113 and a shaft portion 114. The handle portion 113 provides a handle for holding and gripping the locomotive reverser key 112. Shaft portion 114 is attached to the handle portion 113 and extends from the handle portion 113. Handle portion 113 comprises a Light Emitting Diode (LED) 115, a switch mechanism 116, and a battery 117. A lens 118 is attached to an end of the handle portion 113. The LED 115 emits a clear or white light, however, the lens 118 is tinted blue causing the reverser key 112 to emit a blue light when the LED 115 is switched on. In the example of FIG. 3, the switch mechanism 116 involves rotation of bezel portion 119 that causes metal contact between LED 115 and battery 117 resulting in LED 115 to emit light. In another embodiment, the switch mechanism 116 is a push button switch located on the handle portion 113. In yet another embodiment, the switch mechanism 116 push button that is activated by pressing lens 118 inwards towards handle portion 113. In yet another embodiment, the switch mechanism 116 is a sliding switch located on the outer surface of the handle portion 113.

Reverser key 112 is not usable to operate locomotive 100. The shaft portion 114 is unable to disengage any locking mechanism within reverser 106. The shaft portion does not include any V-notch or indentations that will trip a locking mechanism in the reverser. A protruding edge 124 extends from a top edge of the shaft portion 114 to prevent the reverser key 112 from rotating while inserted in the reverser 106. In this fashion, reverser key 112 prevents the reverser 106 from rotating to the forward position 110 or to the reverse position 111 when the reverser key 112 is inserted into the reverser 106. As a result, a train operator will not be able to accidentally move the train after reverser key 112 is inserted into reverser 106. In addition, both the handle portion 113 and the shaft portion 114 are powder coated blue so that a train operator readily will know that the reverser key 112 indicates that a blue signal procedure is in effect. The combination of the blue color of the reverser key 112, the blue light that is emitted from the reverser key 112, and the inability of the reverser key 112 to operate the train, will prevent the train operator from moving the train while the blue signal procedure is in effect.

The handle portion 113 has a first diameter 120 that is greater than one inch. This diameter provides storage capacity for battery 117. The shaft portion 114 has a second diameter 121, and the first diameter 120 of the handle portion 113 is at least one and a half times the second diameter 121 of the shaft portion 114. In addition, a length 122 of the reverser key 112 is greater than three inches to provide space for battery 117 and other electronics within handle 113. However, the length 122 of the reverser key 112 does not exceed eight inches, otherwise it would be unwieldy and difficult for a locomotive operator to carry.

In the example of FIG. 3, the handle portion 113 and the shaft portion 114 is manufactured using Aluminum alloy 6061-T6. However, reverser key 112 need not be constructed of metal and may be constructed of thermoplastic polymer or thermosetting polymer using injection molding techniques. Although in the example of FIG. 3 the outer surface of reverser key 112 is a blue coating, the outer surface may be of a different color, such as white, black, red, orange, yellow, green, red, violet or any combination of colors.

Figure 4:
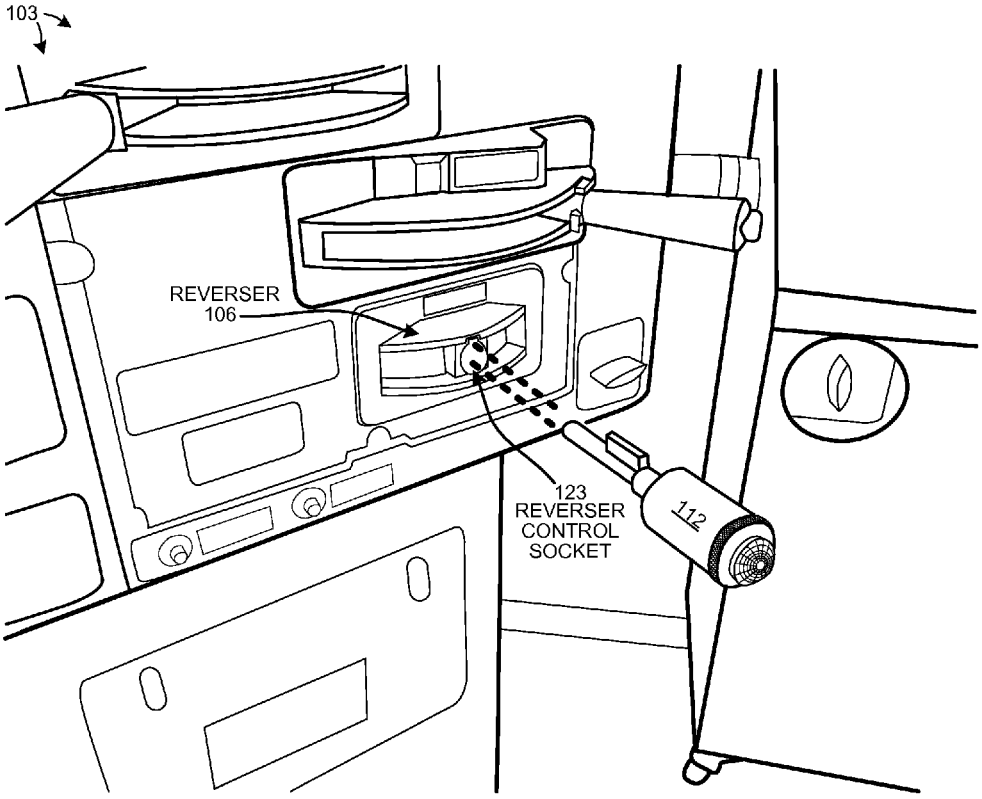
FIG. 4 is a perspective diagram showing the reverser key 112 being inserted into reverser control socket 123 of the reverser 106.

FIG. 4 is a perspective diagram showing the reverser key 112 being inserted into reverser control socket 123 of the reverser 106. After the locomotive operator receives notification of the blue signal procedure, the locomotive operator inserts the reverser key 112 into the reverser so as to prevent accidental operation of the railroad and to inform other operators that may enter the cabin unaware of the blue signal protection. In addition, because the reverser key 112 is occupying reverser control socket 123, it is not possible for the operator to accidently insert an operable train key and move the locomotive.

Figure 5:
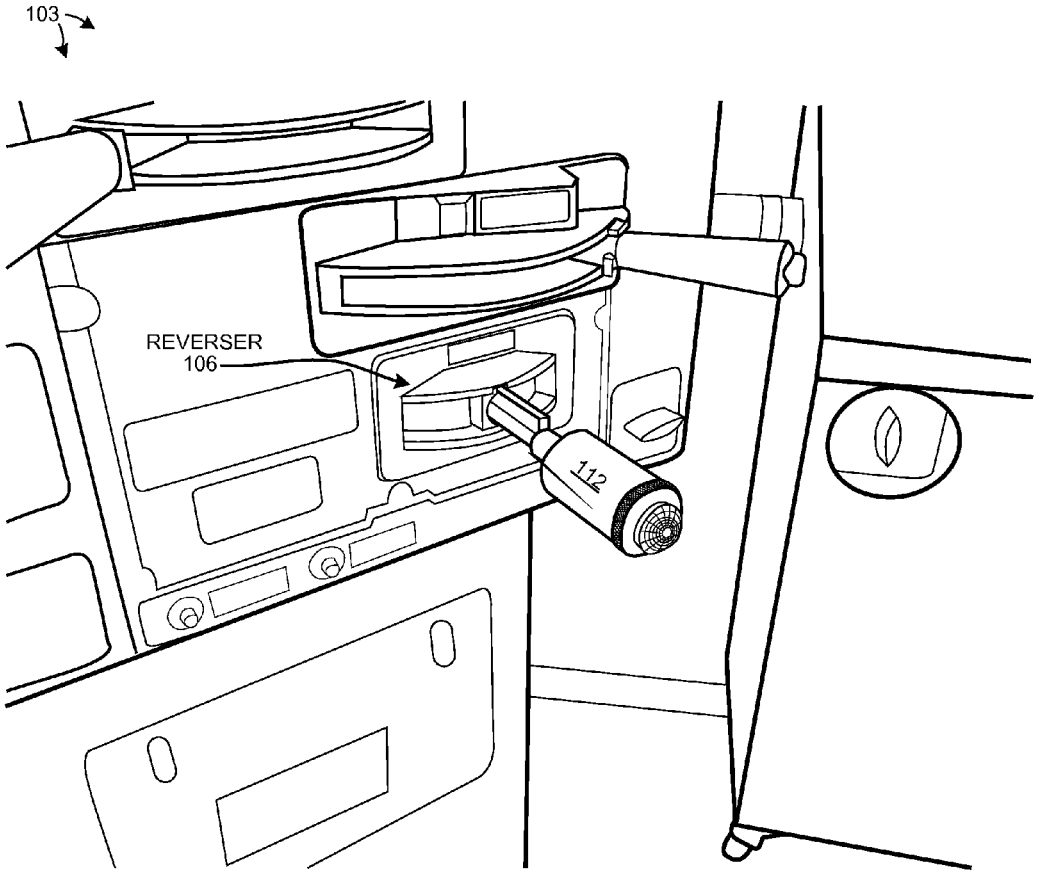
FIG. 5 is a perspective diagram of the control stand 103 after the reverser key 112 is inserted into the reverser 106.

FIG. 5 is a perspective diagram of the control stand 103 after the reverser key 112 is inserted into the reverser 106.

Figure 6:
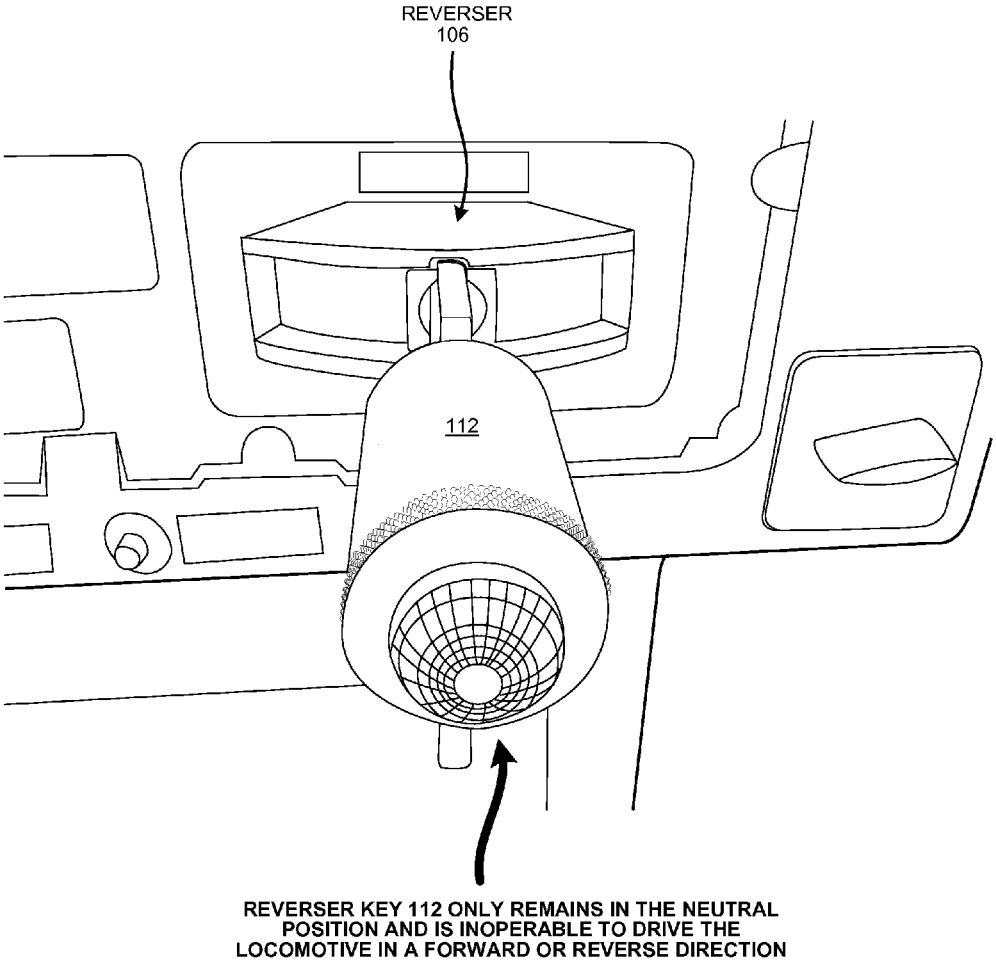
FIG. 6 is another perspective diagram of the control stand 103 after the reverser key 112 is inserted into the reverser 106.

FIG. 6 is another perspective diagram of the control stand 103 after the reverser key 112 is inserted into the reverser 106.

Figure 7:
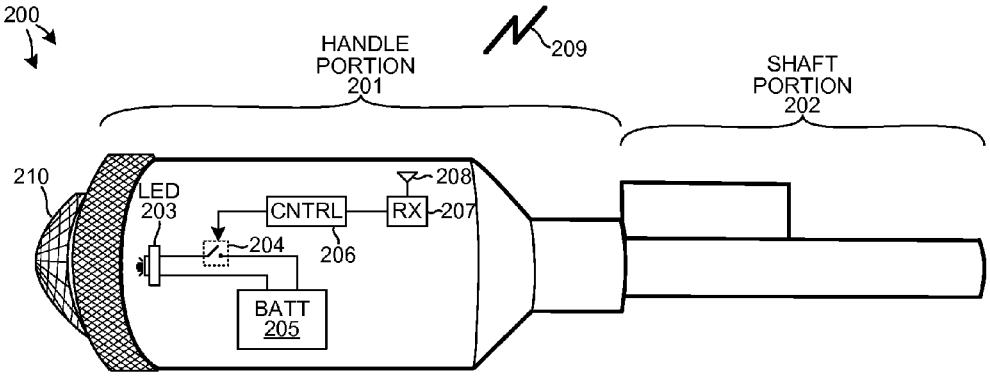
FIG. 7 (second embodiment) is a diagram of another embodiment of a novel reverser key 200.

FIG. 7 is a diagram of a second embodiment of a novel reverser key 200. Reverser key 200 includes a handle portion 201 and a shaft portion 202. Handle portion 201 includes a Light Emitting Diode (LED) 203, switch mechanism 204, battery 205, control circuitry 206, a Radio Frequency (RF) receiver 207, and an antenna 208. An RF signal 209 is received onto antenna 208. Receiver 207 detects the received RF signal 209 and causes control circuitry 206 to control switch mechanism 204 to activate LED 203. A lens 210 is tinted blue resulting in a blue light being emitted from reverser key 200. Utilization of reverser key 200 permits a railroad employee to notify all locomotive operators of the blue signal. After the reverser key 200 is activated and emits a blue light, then the locomotive operators will be informed of the blue signal condition and will know to insert the reverser key 200 into the reverser 106 to prevent any movement of the train.

Figure 8:
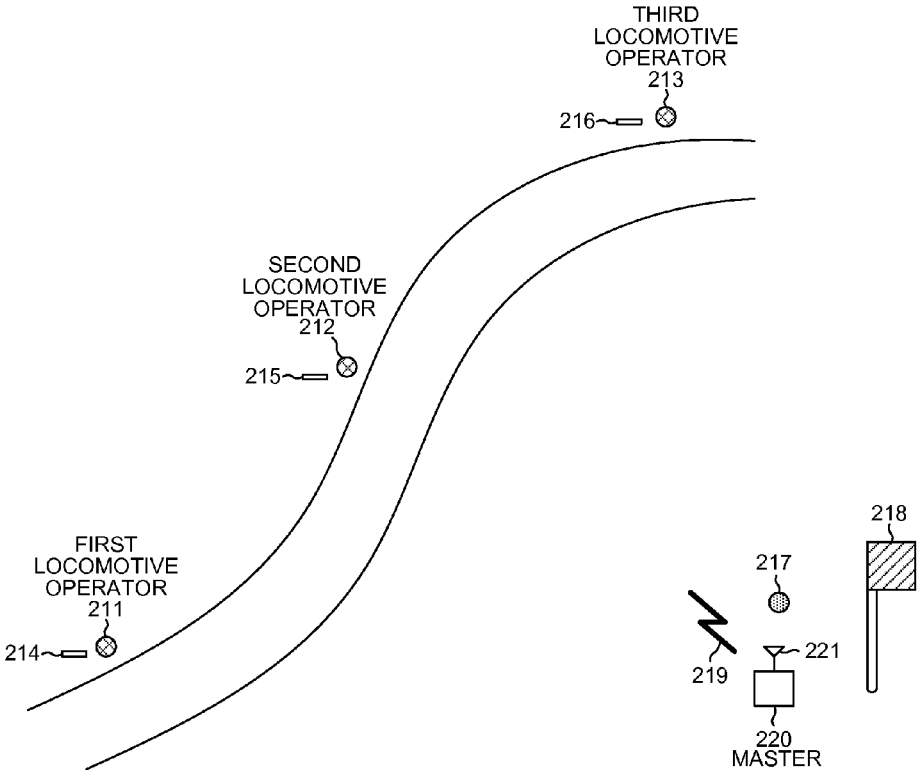
FIG. 8 is a diagram showing how several locomotive operators are notified of the blue signal procedure using novel reverser key 200.

FIG. 8 is a diagram showing how several locomotive operators are notified of the blue signal procedure using novel reverser key 200. Three locomotive operators 211-213 are each equipped with reverser keys 214-216, respectively. A railroad employee 217 initiates a blue signal condition by installing blue flag 218. Railroad employee 217 generates an RF signal 219 transmitted from master controller 220 via antenna 221. RF signal 218 is received onto reverser key 214 causing reverser key 214 to emit a blue light notifying the first locomotive operator 211 of the blue signal procedure. RF signal 218 is also received onto reverser key 215 causing reverser key 215 to emit a blue light notifying the second locomotive operator 212 of the blue signal procedure. RF signal 218 is also received onto reverser key 216 causing reverser key 216 to emit a blue light notifying the third locomotive operator 213 of the blue signal procedure. In this fashion each of locomotive operators 211, 212 and 213 receives notification of the blue signal condition and can proceed to insert of their respective reverser keys into the reverser to prevent any train movement.

Figure 9:
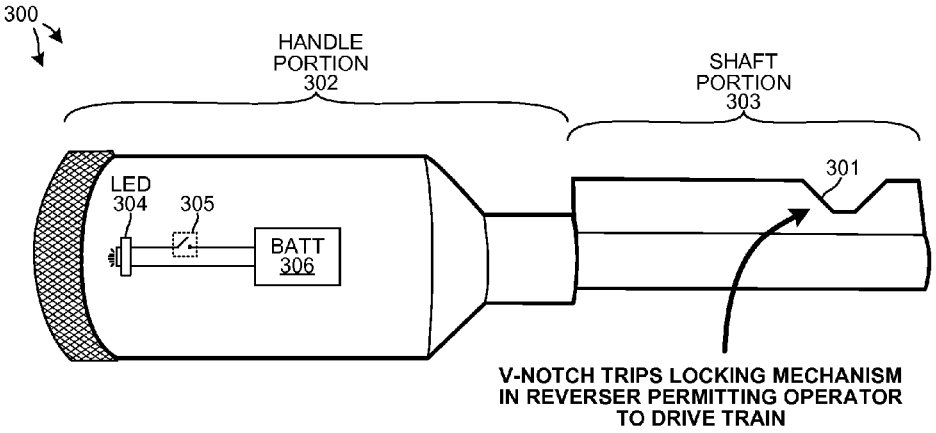
FIG. 9 (third embodiment) is a diagram of another embodiment of a novel reverser key 300.

FIG. 9 is a diagram of a third embodiment of a novel reverser key 300. Reverser key is similar to reverser key 112 in FIG. 2, except that reverser key 300 includes V-notch 301 that unlocks tripping mechanism within the reverser 106. Reverser key 300 is a fully functional train key and is usable by a locomotive operator to control the reverser 106 and drive the train forwards and backwards. Reverser key 300 includes handle portion 302 and shaft portion 303. Handle portion 302 contains electronic devices convenient for use by a locomotive operator. In this example, handle portion 302 comprises a Light Emitting Diode (LED) 304, a switch mechanism 305, and a battery 306. In this fashion, reverser key 300 has a dual use in that it functions as a train key to control the reverser 106 and also functions as a flashlight.

The handle portion 302 may include other electronic devices of utility to a locomotive operator. For example, handle portion 302 may include a Global Position System (GPS) module that would provide the train operator with GPS coordinates. Such positioning information is useful to the train operator when the train operator needs to know their precise location or to determine the distance from a destination. Handle portion 302 may include a Radio Frequency Identification (RFID) module used by the locomotive company to track each train operator and to gather information such as which trains were operated by a particular train operator. The handle portion 302 may include a microphone so that a train operator may record notes and other observations during operation routes. In addition, handle portion 302 may include a microcontroller for controlling and communicating with other electronic devices. The handle portion 302 may include a wireless interface module for performing wireless communication with a wireless local area network on board the train. The handle portion 302 may include a camera module permitting the train operator to take photographs. In addition, the handle portion 302 may include a fingerprint sensor so that only certain qualified train operators may have access to the reverser key.

Figure 10:
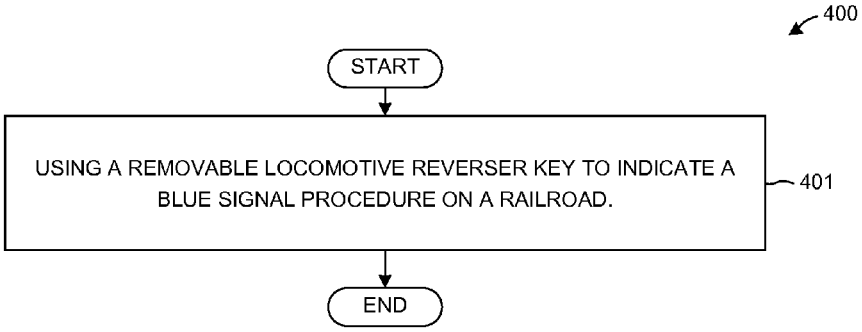
FIG. 10 is a flowchart of a methods 400 in accordance with one novel aspect.

FIG. 10 is a flowchart of a method 400 in accordance with one novel aspect. In a first step (step 401), a removable locomotive reverser key is used to indicate a blue signal procedure on a railroad. For example, in FIG. 4, a train operator receives notification that a blue signal procedure is in effect. The train operator activates the LED 115 of the reverser key 112 causing a blue light to be emitted from the reverser key 112. The train operator then inserts the reverser key 112 into the reverser control socket 123 of the reverser 106. In this fashion, the train operator uses the reverser key 112 to indicate that a blue signal procedure is in effect and the train should not be moved until the blue signal procedure ends.

Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A locomotive reverser key comprising:

a handle portion, wherein the handle portion comprises a light source and a switch mechanism, and wherein the switch mechanism controls the light source to be in an on state or an off state; and a shaft portion, wherein the shaft portion is attached to the handle portion and extends from the handle portion, wherein the shaft portion is insertable into a reverser control socket of a reverser, and wherein the reverser is part of a locomotive.

2. The locomotive reverser key of claim 1, wherein the locomotive reverser key is operable to drive the locomotive in a forward direction, and wherein the locomotive reverser key is operable to drive the locomotive in a reverse direction.

3. The locomotive reverser key of claim 1, wherein the handle portion and the shaft portion are constructed of an injection molded polymer.

4. The locomotive reverser key of claim 1, wherein light is emitted from the light source through an end of the handle portion when the light source is in the on state, and wherein no light is emitted from the light source through the end of the handle portion when the light source is in the off state, and wherein the handle portion further includes:

a battery that supplies the light source.

5. The locomotive reverser key of claim 1, wherein the handle portion has a first diameter, wherein the first diameter is greater than one inch, wherein the shaft portion has a second diameter, and wherein the first diameter is at least one and a half times the second diameter.

6. The locomotive reverser key of claim 1, wherein the handle portion has a first length, wherein the shaft portion has a second length, wherein a sum of the first length and the second length is greater than three inches, and wherein the sum does not exceed eight inches.

7. The locomotive reverser key of claim 1, wherein the locomotive reverser key is operable as a flashlight.

8. The locomotive reverser key of claim 1, wherein the light source is a Light Emitting Diode (LED).

9. The locomotive reverser key of claim 1, wherein the shaft portion has a V-notch operable to engage the reverser of the locomotive.

10. A locomotive reverser key comprising:

a handle portion; and a shaft portion, wherein the shaft portion is attached to the handle portion and extends from the handle portion, wherein the shaft portion is insertable into a reverser control socket of a reverser, wherein the reverser is part of a locomotive and the reverser is rotateably engageable in a forward position, a neutral position, and a reverse position, and wherein the handle portion includes an electronic device and a switch that toggles the electronic device between an on state and an off state, and wherein the electronic device is selected from the group consisting of: a Global Position System (GPS) module, a Radio Frequency Identification (RFID) module, a Radio Frequency (RF) receiver, a microphone, a microcontroller, a wireless interface module, a camera module, a fingerprint sensor module, and a light source.

11. The locomotive reverser key of claim 10, wherein the locomotive reverser key is operable to drive the locomotive in a forward direction, and wherein the locomotive reverser key is operable to drive the locomotive in a reverse direction.

12. The locomotive reverser key of claim 10, wherein the locomotive reverser key is not operable to drive the locomotive in a forward direction, and wherein the locomotive reverser key is not operable to drive the locomotive in a reverse direction.

13. The locomotive reverser key of claim 10, wherein the handle portion and the shaft portion are constructed of an injection molded polymer.

14. The locomotive reverser key of claim 10, wherein the electronic device is a light source, and wherein the handle portion further comprises:

a lens at an end of the handle portion, wherein the lens causes a light indicative of a blue signal procedure to be emitted when the light source is activated.

15. The locomotive reverser key of claim 10, wherein the electronic device is an RF receiver, wherein the handle portion also includes a light source, and wherein a signal received onto the RF receiver causes the light source to be activated.

16. The locomotive reverser key of claim 10, wherein the handle portion has a first diameter, wherein the shaft portion has a second diameter, and wherein the first diameter is at least one and a half times the second diameter.

17. A functional locomotive reverser key comprising:

a handle portion; and a shaft portion, wherein the shaft portion is attached to the handle portion and extends from the handle portion, wherein the shaft portion is insertable into a reverser control socket of a reverser, wherein the reverser is part of a locomotive and the reverser is rotateably engageable in a forward position, a neutral position, and a reverse position, and wherein the handle portion comprises:

a light source;

a battery that supplies the light source; and a switch mechanism operable to switch the light source on and off.

18. The functional locomotive reverser key of claim 17, wherein the handle portion and the shaft portion are constructed of an injection molded polymer, and wherein the light source is a Light Emitting Diode (LED).

19. The functional locomotive reverser key of claim 17, wherein the shaft portion has a V-notch, and wherein the V-notch is operable to engage the reverser of the locomotive.

* * * * *